US012138503B2

(12) United States Patent
Chen

(10) Patent No.: US 12,138,503 B2
(45) Date of Patent: Nov. 12, 2024

(54) ADJUSTABLE KETTLEBELL DEVICE

(71) Applicant: Yongkang Jiebao Industry and Trade Co., Ltd, Jinhua (CN)

(72) Inventor: Huiguan Chen, Jinhua (CN)

(73) Assignee: Yongkang Jiebao Industry and Trade Co., Ltd

( * ) Notice: Subject to any disclaimer, the term of this patent is extended or adjusted under 35 U.S.C. 154(b) by 0 days.

(21) Appl. No.: 18/237,418

(22) Filed: Aug. 24, 2023

(65) Prior Publication Data

US 2024/0181288 A1 Jun. 6, 2024

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0726* (2013.01); *A63B 21/0728* (2013.01)

(58) Field of Classification Search
CPC ..... A63B 21/0724; A63B 21/0726; A63B 21/0728; A63B 21/075
See application file for complete search history.

(56) References Cited

U.S. PATENT DOCUMENTS

| | | | | |
|---|---|---|---|---|
| 7,052,445 | B2 * | 5/2006 | Ekhaus | A63B 21/0601 482/109 |
| 7,762,933 | B1 * | 7/2010 | Yu | A63B 21/075 482/109 |
| 7,976,443 | B2 * | 7/2011 | Krull | A63B 21/0728 482/107 |
| 8,784,280 | B2 * | 7/2014 | Krull | A63B 21/00065 482/106 |
| 10,099,083 | B1 * | 10/2018 | Owusu | A63B 24/0062 |
| 11,185,731 | B2 * | 11/2021 | Wang | A63B 21/075 |
| RE49,009 | E * | 4/2022 | Wang | A63B 21/072 |
| 2006/0035767 | A1 * | 2/2006 | Ekhaus | A63B 21/0601 482/50 |
| 2011/0263392 | A1 * | 10/2011 | Yu | A63B 21/075 482/93 |
| 2018/0036578 | A1 * | 2/2018 | Moran | A63B 21/0728 |
| 2018/0117387 | A1 * | 5/2018 | Wang | A63B 21/072 |
| 2019/0366142 | A1 * | 12/2019 | Dale | A63B 21/0724 |

* cited by examiner

*Primary Examiner* — Joshua Lee
(74) *Attorney, Agent, or Firm* — Jose Cherson Weissbrot

(57) ABSTRACT

The present invention provides a bell blades connection structure and a training apparatus for use thereof, comprising a main part and a plurality of bell blades, the main part being provided with a limit block, and the bell blades being fitted with a locking mechanism and a limit block for connecting therewith, said locking mechanism on said bell blades receiving and locking the limit block when the kettlebell is in a state of use, and said locking mechanism releasing the limit block when the kettlebell is in a state of stowage, and the bell blades being movable away from the main part or from another bell blades.

15 Claims, 13 Drawing Sheets

ADJUSTABLE KETTLEBELL DEVICE

TECHNICAL FIELD

The present invention relates to the technical field of fitness equipment and, in particular, to a bell blade connection structure and a training apparatus using the same.

BACKGROUND

Training equipment with a bell blade structure is commonly used to improve muscle strength training simple equipment, using kettlebell or barbell and other fitness exercises, you can do a variety of pushing, lifting and squatting exercises, kettlebell, dumbbell and barbell training helps to improve the overall explosive force, and very efficient, therefore, more and more people like to use this type of training equipment for exercise.

However, the traditional kettlebell or barbell is not conveniently connected to its bell blades and is prone to loosening, for example, U.S. Patent No. US20110263392A1 which discloses an adjustable variable weight trainer which requires more time to assemble and is fixed by bolts when in use, and the bell blades are prone to loosening after a long period of time, and similarly, U.S. Pat. No. 7,762,933 which discloses a variable weight trainer which is prone to loosening after a long period of time. Similarly, the adjustable weight kettle dumbbells disclosed in U.S. Pat. No. 7,762,933 also require more time to assemble and is similarly time consuming and laborious.

Based on the above problems, it is necessary to propose a new type of training apparatus having the structure of bell blades, which does not need to spend a lot of time in assembling, and at the same time the assembling process is simple, and the splicing structure is solid, so as to facilitate the user to perform diversified training.

SUMMARY

The present invention provides a bell blade connection mechanism comprising a locking mechanism and a connection, the locking mechanism comprising an upper base, a lower base fixedly connected to the upper base, and a limit plate, the limit plate elastically connected in the upper base and having a locking position and a release position, and a limit hole provided on the limit plate, the limit hole comprising a restrictor and a release section, and the lower base being provided with a insertion hole, the insertion hole defining a passageway for an external object to reach the limit hole, connection forming a fixed connection with the upper base including a latch: when limit plate is in the locked position, the limit hole is away from the passageway defined by the insertion hole, and when limit plate is in the released position, the limit hole is on the passageway defined by the insertion hole.

The present invention provides a kettlebell including a main part and a plurality of bell blades, the main part including a frame, a center block, a connecting arm connecting the frame and the center block, and a connection limit block provided on the center block; the bell blades including a hub having an outer peripheral boundary, an outer ring defined by the outer peripheral boundary, and an extension arm extending outwardly from the hub for connecting the outer ring. hub has an active cavity with a locking mechanism disposed in the active cavity: the locking mechanism comprising a upper base, a lower base fixedly connected to the upper base, and a limit plate, the limit plate elastically connected in the upper base and having a locking position and a release position, the limit plate also having a limit hole disposed thereon, the limit hole comprising a restrictor and a release section, and the lower base having an insertion hole disposed thereon, the insertion hole defining a passageway for an external object to reach the limit hole, said connection forming a fixed connection with the upper base including a latch; when the limit plate is in the locked position, the limit hole is away from the passageway defined by the insertion hole, and when the limit plate is in the released position, the limit hole is in the passageway defined by the insertion hole: when the kettlebell is in the use state, a locking mechanism on the bell blades receives and locks the limit block, and when the kettlebell is in the stowed state, the locking mechanism releases the limit block, and the bell blades may be located away from the main part or another bell blade.

The present invention provides a barbell comprising a sharpen and a plurality of bell blades, with a limit block provided at each end of the sharpen: the bell blades comprising a hub having an outer periphery, an outer ring defined by the outer periphery, and an extension arm extending outwardly from the hub to connect to the outer ring, the hub having an active cavity, with the locking mechanism mounted in the active cavity: the locking mechanism comprising an upper base, a lower base fixedly connected to the upper base, and a limit plate, the limit plate elastically connected in the upper base and having a locking position and a release position, and a limit hole provided in the limit plate, the limit hole including a restrictor and a release section, and the lower base provided with a insertion hole, the insertion hole defining a passageway for an external object to reach the limit hole, and the connection forming a fixed connection including a latch: when the limit plate is in the locked position, the limit hole is away from the passageway defined by the insertion hole, and when the limit plate is in the released position, the limit hole is on the passageway defined by the insertion hole: when the barbell is in the use state, the locking mechanism on the bell blades receives and the locks the limit block, and when the barbell is in the stowed state, the locking mechanism releases the limit block, and the bell blades may be moved away from the sharpen or another bell blade.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
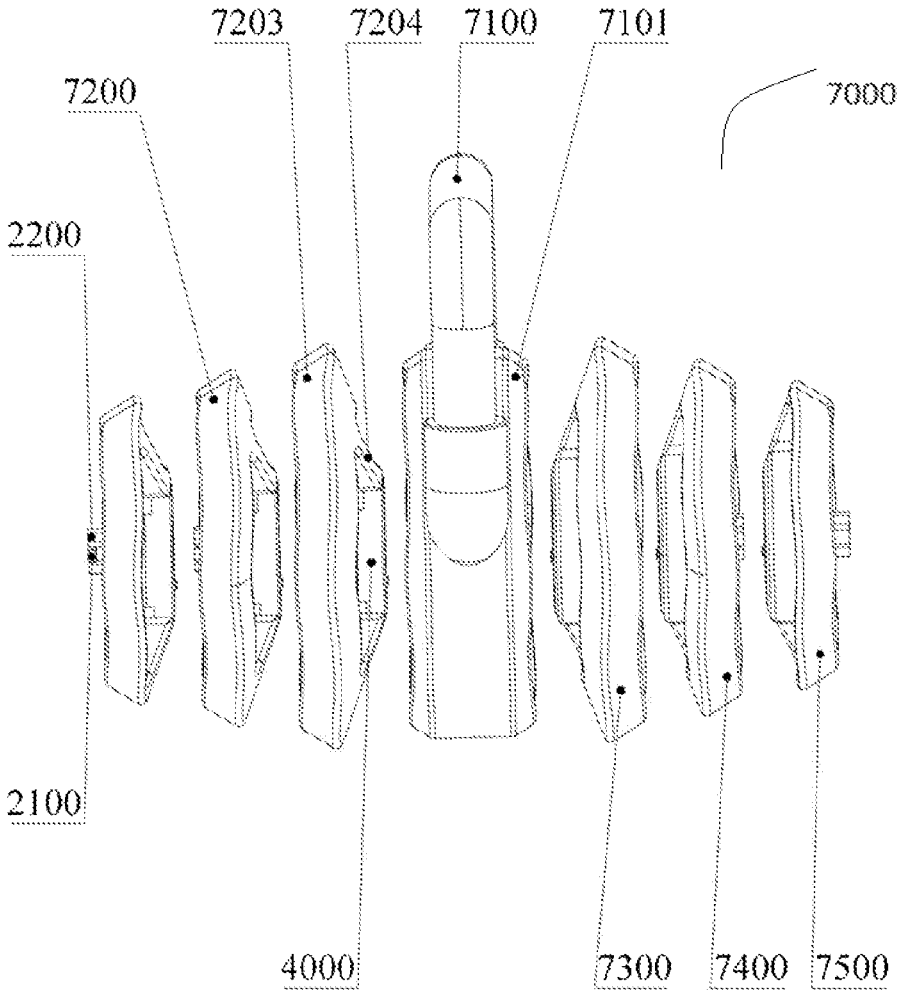
FIG. 1 shows a schematic view of the bell blades when disassembled from the main part.

2100, latch; 2200, limit block; 3000, upper base; 3100, hexagonal groove; 3200, first through hole; 3300, Insertion slot; 3400, receiver block; 3500, hexagonal slot; 3600, fixed slot; 3700, raised edge; 3800, sliding slot; 4000, lower base; 4100, insertion hole; 4200, second through hole; 4300, round slot; 4400, raised layer; 4500, projection; 4600, limit strip; 4700, protruding round block; 5000, limit plate; 5001, limit hole; 5002, restrictor; 5003, release section; 5004, clip block; 5005, tap; 6000, elastomer; 7000, kettlebell; 7100, main part; 7101, frame; 7102, center block; 7103, connecting arm; 7104, third through hole; 7105, insert; 7200, bell blade; 7201, hub; 7202, active cavity; 7203, outer ring; 7204, extension arm; 7205, attachment table; 7206, fourth through hole; 7300, first stage bell piece; 7400, second stage bell piece; 7500, third stage bell piece; 8000, barbell; 8100, sharpen; 8101, first pin hole; 8200, connection post; 8201, second pin hole; 8202, fifth through hole; 9000, bottom box; 9001, kettlebell slot; 9002, kettlebell tray; 9003, kettlebell holder; 9004, cards; 9005, grip slot; 9006, kettlebell tray.

DESCRIPTION OF EMBODIMENTS

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other. In the following, the technical scheme in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by those skilled in the art without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

As shown in FIGS. 1 to 8, the present invention provides a spliced kettlebell comprising a main part 7000, a plurality of bell blades 7200 and a connecting mechanism, the connecting mechanism comprising a limit block 2200, an upper base 3000, a lower base 4000, a limit plate 5000 and an elastomer 6000.

Figure 2:
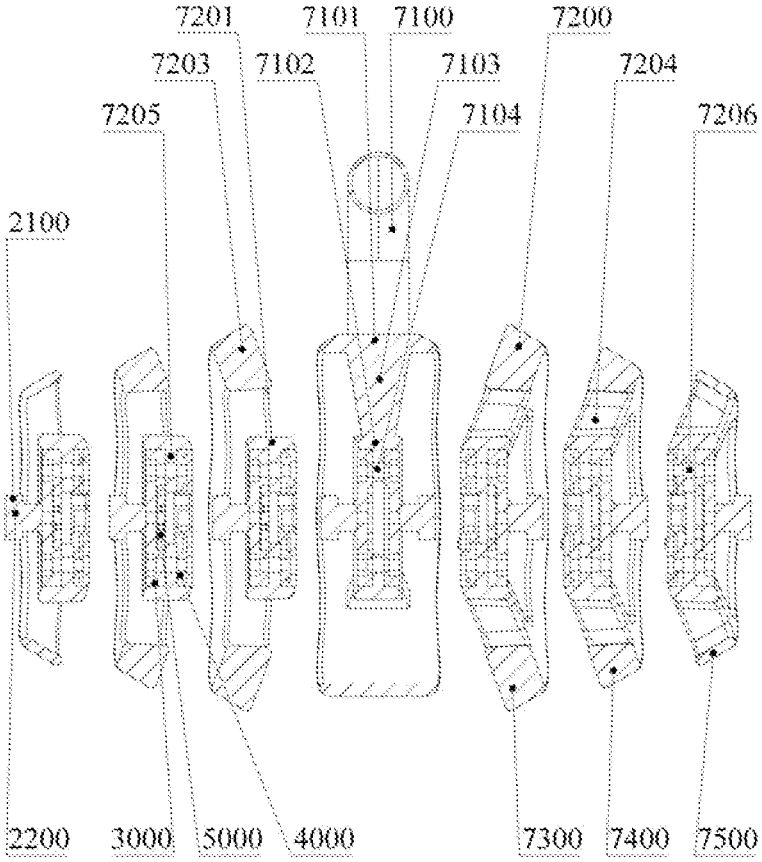
FIG. 2 shows a sectional view of the bell blades and main part when disassembled.
Figure 3:
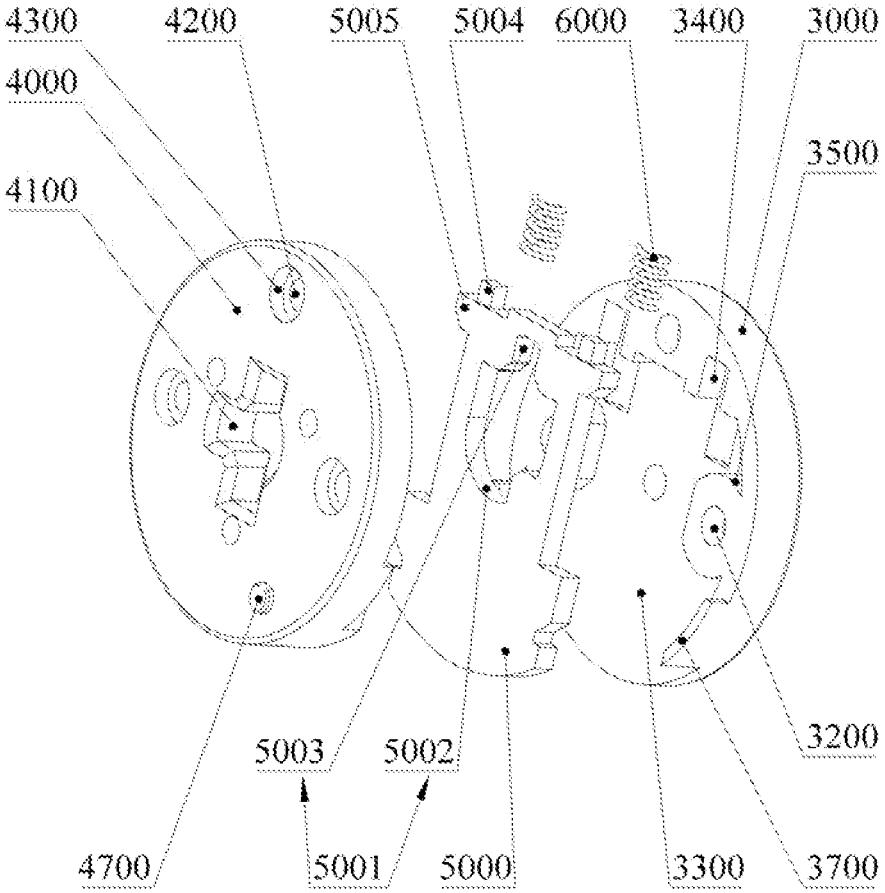
FIG. 3 shows a schematic view of locking mechanism.
Figure 4:
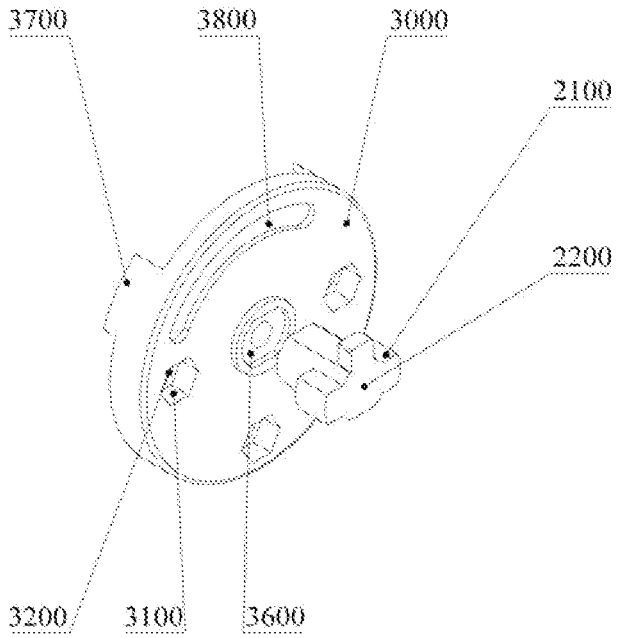
FIG. 4 shows a schematic view of the connection.
Figure 5:
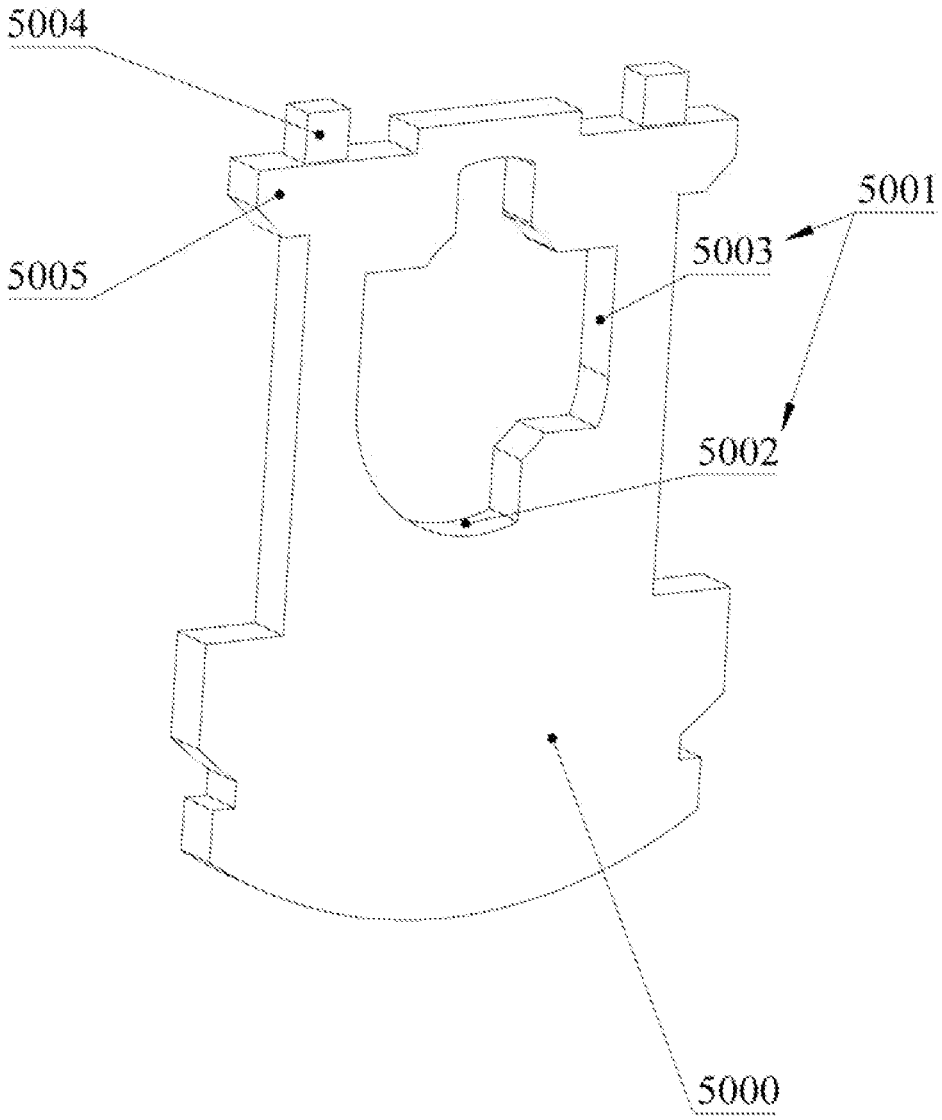
FIG. 5 shows a schematic view of limit plate.
Figure 6:
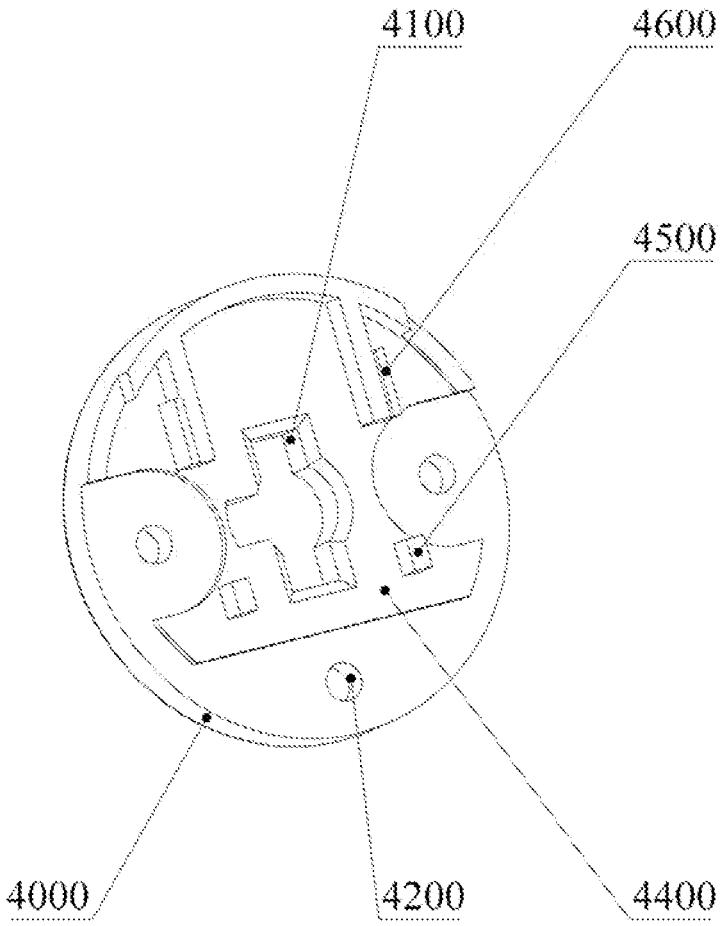
FIG. 6 shows a schematic view of a second end face of lower base.

As shown in FIGS. 1 to 2, in this embodiment, the bell blades 7200 are divided into three levels, with the two bell blades closest to the main part 7100 on the left and right as the first stage bell piece 7201, and the second stage bell piece 7202 active cavity and the third stage bell piece 7203 outer ring in that order outwardly. The first stage bell piece has the largest counterweight, and the third stage bell piece has the smallest counterweight. In other embodiments (not shown in the figures), the bell blade locking mechanism is not limited to three levels, and in order to allow the user to exercise effectively or to provide the user with more options, the number of levels of the bell blade locking mechanism may also be two levels, four levels, or any other desired number of bell blades levels.

As shown in FIGS. 1 to 8, in this embodiment, the main part 7100 comprises a frame 7101, a center block 7102, a connecting arm 7103 connecting frame 7101 and a center block 7102, wherein the center block 7102 is provided with third through hole 7104 and an insert corresponding 7105 to said upper base 3000, and the upper base 3000 and the center block 7102 form a fixed connection by means of a screw, and in other embodiments (not shown in the figures), the connection includes but is not limited to a screw connection, but may also be a pin connection, a weld and any connection in accordance with the will.

As shown in FIGS. 1 to 8, in this embodiment, a first end face of the upper base 3000 is provided with a Insertion slot 3300 corresponding to limit block 2200, with a through hole provided in Insertion slot 3300, and said center block 7102 and said upper base 3000, and said limit block 2200 are formed into a fixed connection by means of screws. In other embodiments (not shown in the figures), the connection includes, but is not limited to, a screw connection, but may also be a pin connection, a weld, and any other connection that meets the will.

As shown in FIGS. 1 to 8, The bell blade 7200 comprises a hub 7201 having an outer periphery, an outer ring 7203 defined by the said outer periphery, and an extension arm 7204 extending outwardly from said hub 7201 for connecting said outer ring 7203, wherein in this embodiment the outer ring 7203 is configured as a polygonal closed ring, the hub 7201 is set up as a semi-circular open ring, and the extension arm 7204 extends from both ports of said hub to said polygonal closed ring.

In other embodiments (not shown in the figures), the outer ring 7203 is not limited to a polygonal closed ring, but may also be a circular closed ring, a polygonal open ring or any other desired shape. In other embodiments (not shown in the figures), the hub 7201 is not limited to a semicircular open ring, but may also be a circular closed ring, a polygonal open ring, or any other shape desired. In other embodiments (not shown in the figures), the extension arm 7204 is not limited to two arms protruding from the ends of the hub 7201, but may be any other shape desired.

Figure 7:
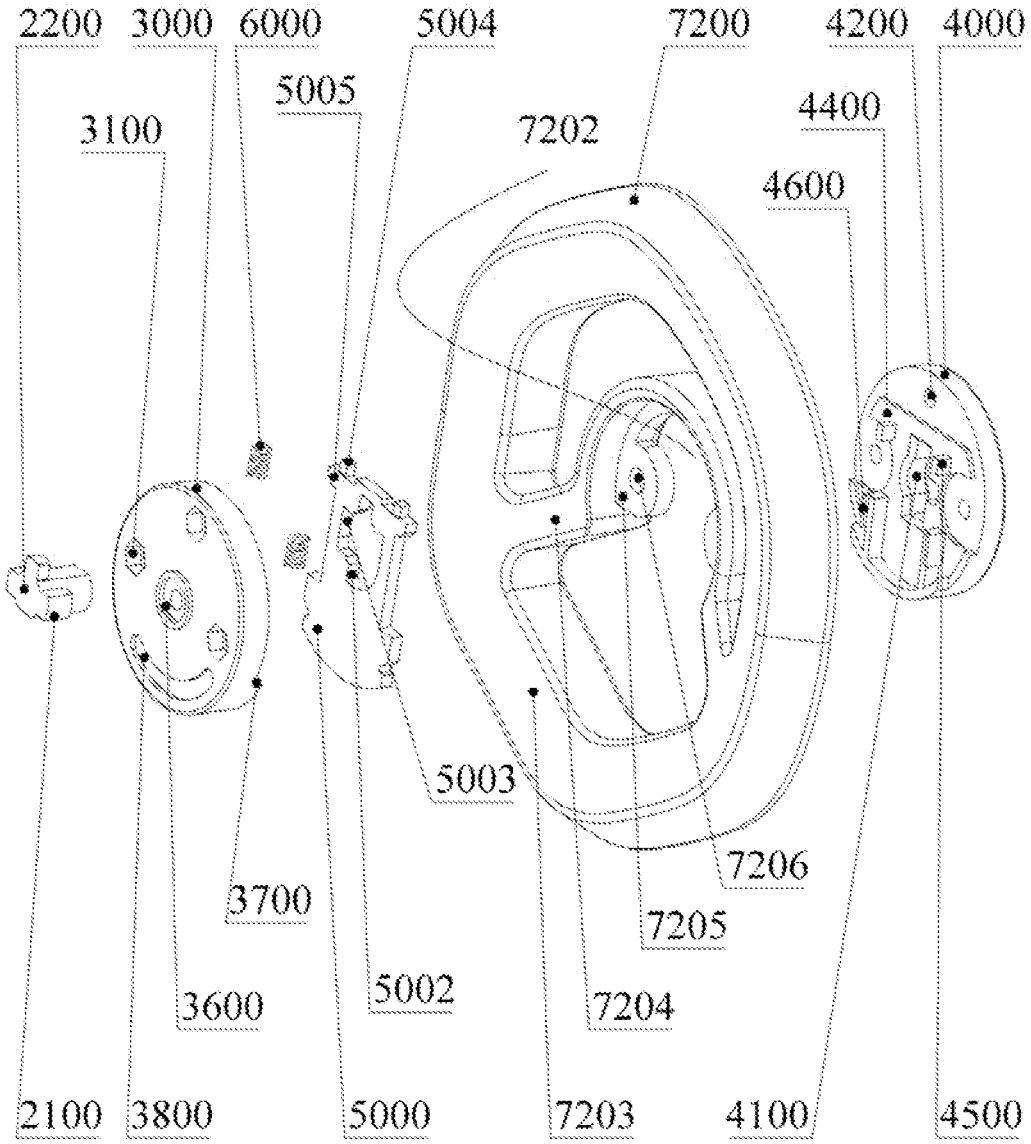
FIG. 7 shows an exploded schematic view of bell blades when assembled with a connecting mechanism.
Figure 8:
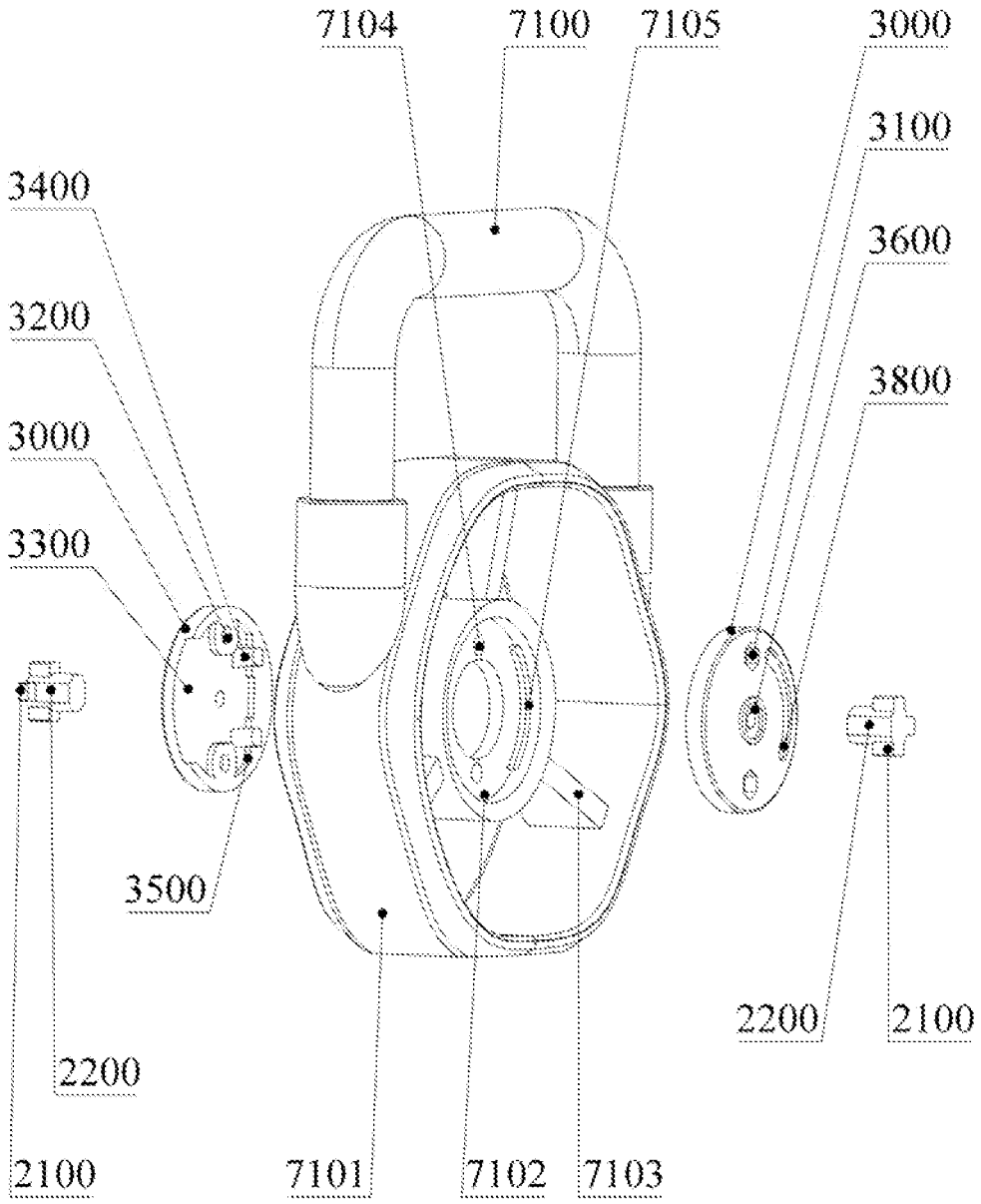
FIG. 8 shows a schematic view of an explosion when main part is assembled with connection.

As shown in FIG. 7, in this embodiment, the hub 7201 has an active cavity 7202 with a locking mechanism mounted in said active cavity and a locking mechanism comprising an upper base 3000, a lower base 4000, a limit plate 5000 and an elastomer 6000.

As shown in FIGS. 3 to 8, in this embodiment, the upper base 3000 is provided with three hexagonal grooves 3100 on a first end face, a first through hole 3200 is provided in the hexagonal groove, and the hexagonal groove 3100 can be used to secure a nut. In this embodiment, the inner surface of the upper base 3000 is provided with a Insertion slot 3300 that can be embedded to secure the limit plate 5000, and the second end face of the upper base 3000 is also provided with a raised edge 3700 to provide space for the hub 7201.

As described in FIGS. 3 to 8, in this embodiment, the first end face of the lower base 4000 is provided with a raised layer 4400 that can be embedded in the bell blade hub 7201, and the raised layer 4400 is provided with a projection 4500, and the projection 4500 cooperates with the raised edge 3700 provided on the inner surface of the upper base 3000 to provide space for embedding the bell blades hub 7201 and the limit block 2200 space for rotation, the projection 4500 is provided with a limit strip 4600, the limit strip 4600 for restricting the activity of limit plate 5000, and three second through holes 4200 corresponding to the first through hole 3200 are also provided.

As shown in FIGS. 3 to 8, in this embodiment, the second end face of the lower base 4000 is provided with three round slots 4300 and the round slot 4300 is in communication with the second through hole 4200 for embedding hexagonal screws, and a protruding round block 4700 is provided with a protruding round block 4700 that corresponds to a sliding slot 3800 on the outer surface of the upper base 3000 for limiting the upper base 3000 and the lower base 4000. The lower base 4000 is provided with an insertion hole 4100 in the center for insertion of the limit block 2200, and the insertion hole 4100 is provided with a chamfer to facilitate access to limit block 2200. In other embodiments (not shown in the figures), the round slot 4300 is not limited to a circle, but may also be a triangle, a square or any other desired geometric shape.

As shown in FIGS. 4 to 8, in this embodiment, the limit block 2200 includes a latch 2100. The latch 2100 is shaped in the form of a "T" with wider sides and a thinner center. In some embodiments (not shown in the figures), the latch 2100 may also be "Y" shaped, and any shape that allows the limit block 2200 to snap to the limit plate 5000.

As shown in FIGS. 1 to 8, in this embodiment, the limit plate 5000 is provided with a clip block 5004 at one end, and the elastomer 6000 is pivotally connected to clip block 5004, elastomer is a spring in this embodiment, and in other embodiments (not shown in FIGS.), the elastomer is not limited to a spring, but can also be a steel spring, a gas spring, and any other resilient structure as desired. In this embodiment, a tap 5005 is provided on the limit plate 5000, and a limit hole 5000 is also provided on the limit plate 5000, the limit hole 5001 comprising a restrictor 5002 and a release section 5003, the release section 5003 corresponding to the latch 2100, and the restrictor 5002 limiting the rotational range of said latch 2100, wherein, when the limit plate 5000 is in the locked position, the latch 2100 is unable to enter the limit hole 5001 or the latch 2100 is stuck by the restrictor 5002 and is unable to leave the limit hole 5001, and when the limit plate 5000 is in the released position, the latch 2100 is free to enter and exit the limit hole 5001 and can be rotated to the restrictor 5002 or said release section 5003.

As shown in FIGS. 1 to 8, in this embodiment, the hub 7201 has an active cavity 7202, a locking mechanism is disposed in the active cavity 7202, wherein the hub 7201 is provided with an attachment table 7205 that can be embedded in the locking mechanism, a first end face of the upper base 3000 is provided with at least one hexagonal groove 3100, the hexagonal groove 3100 is provided within the hexagonal groove through the first through hole 3200, the second end face of the upper base 3000 is provided with an insertion slot 3300 that can accommodate limit plate 5000, the attachment table 7205 is provided with a fourth through hole 7206 that corresponds to the first through hole 3200, the first end face of the lower base 4000 is provided with the at least one second through hole 4200 that corresponds to the first through hole 3200, the second end face of the lower base 4000 is provided with the fourth through hole 7206 that corresponds to a round slot 4300, and the hub 7201 and the locking mechanism form a fixed connection by means of a screw. In other embodiments, the connection is not limited to a screw connection, but may also be a pin connection, a weld connection, and any other connection that meets the will.

As shown in FIGS. 1 to 8, in this embodiment, the limit plate 5000 is provided with clip block 5004 at one end, an elastomer 6000 is pivotally connected to the clip block 5004, and receiver block 3400 is provided within insertion slot 3300 to receive elastomer 6000, wherein receiver block 3400 receives elastomer 6000 as well as pivotally connected to said elastomer 6000 with clip block 5004, the limit plate 5000 forming a resilient connection with said upper base 3000. The tab 5005 is provided on the limit plate 5000, and a hexagonal slot 3500 limiting the up and down movement of said tab 5005 is provided within the insertion slot 3300 of upper base, wherein when tab 5005 is in close proximity with hexagonal slot 3500 to the elastomer 6000 at one end, the limit plate 5000 reaches a released position, and when the tab 5005 contacts the other end of hexagonal slot 3500, the limit plate 5000 reaches a locked position. The limit plate 5000 is further provided with a limit hole 5001, the limit hole 5001 comprising a restrictor 5002 and a release section 5003, the release section 5003 corresponding to latch 2100 corresponding to the restrictor 5002 limiting the rotational range of said latch 2100, wherein when the limit plate 5000 is in the locked position, said latch 2100 is unable to enter the limit hole 5001 or latch 2100 is stuck by restrictor 5002 and unable to leave said limit hole 5001, and when the limit plate 5000 is in the released position, the latch 2100 is free to enter or exit said limit hole 5001 and can be rotated to said the restrictor 5002 or the release section 5003. The lower base 4000 is provided with insertion hole 4100, the insertion hole 4100 corresponding to the latch 2100, wherein when the limit plate 5000 is in the released position, the insertion hole 4100 corresponds to the limit hole 5100, the insertion hole 4100 limiting the external passageway for an object to reach the limit hole 5001. The upper base 3000 is provided with a fixed slot 3600 securing connection at a first end face, the fixed slot 3600 corresponding to connection, the connection comprising latch 2100 as described above, the fixed slot 3600 forming a fixed connection with connection and latch 2100. when the limit plate 5000 is in the locked position, the limit hole 5001 is away from said channel defined by the insertion hole 4100, and when said limit plate 5000 is in the released position, the limit hole 5001 is on said channel defined by said insertion hole 4100.

When the kettlebell 7000 is in use, the limit block 2200 enters the limit hole 5001 in the limit plate 5000 insertion hole 5001 of the lower base 4000 in the locking mechanism, the restrictor 5002 of the limit hole 5001 receives and locks limit block 2200, and when said kettlebell 7000 is in stowed position, locking mechanism release section 5003 releases limit block 2200 which moves away from main part or another of said bell blade 7200 insertion holes 4100.

Figure 9:
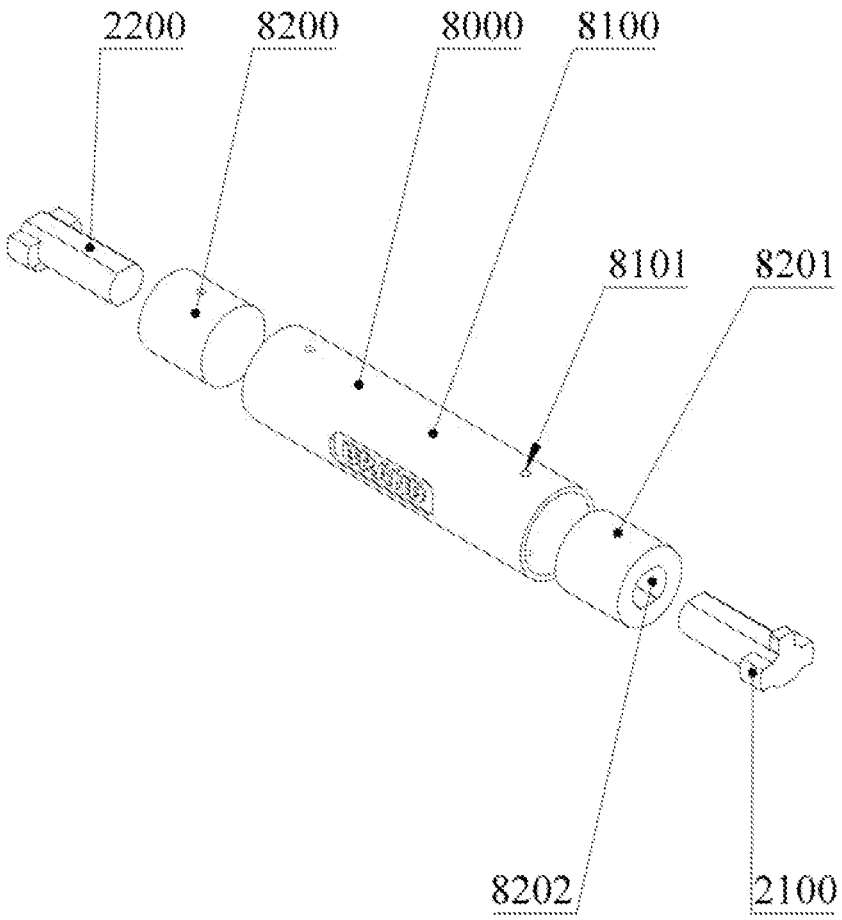
FIG. 9 shows a schematic view of an explosion of an sharpen when assembled with a limit block.
Figure 10:
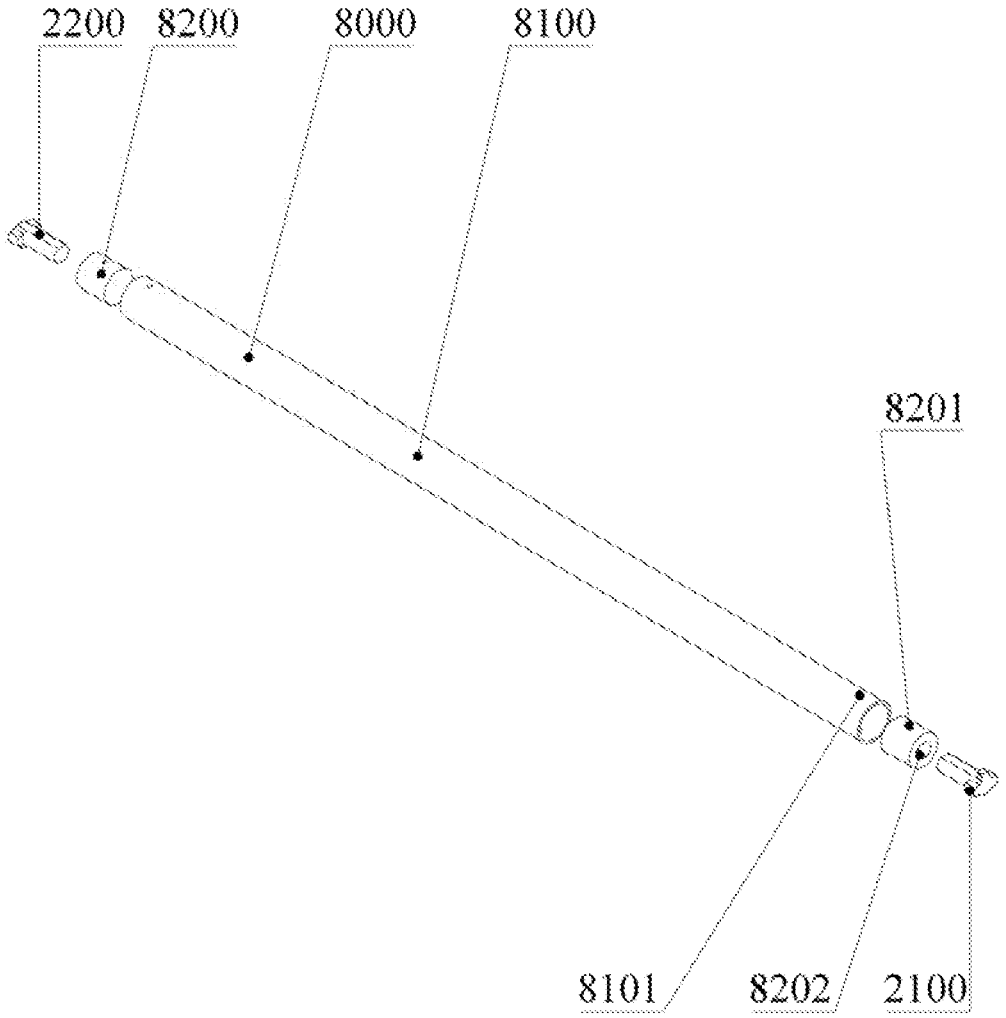
FIG. 10 shows a schematic view of another sharpen when assembled with a limit block.
Figure 11:
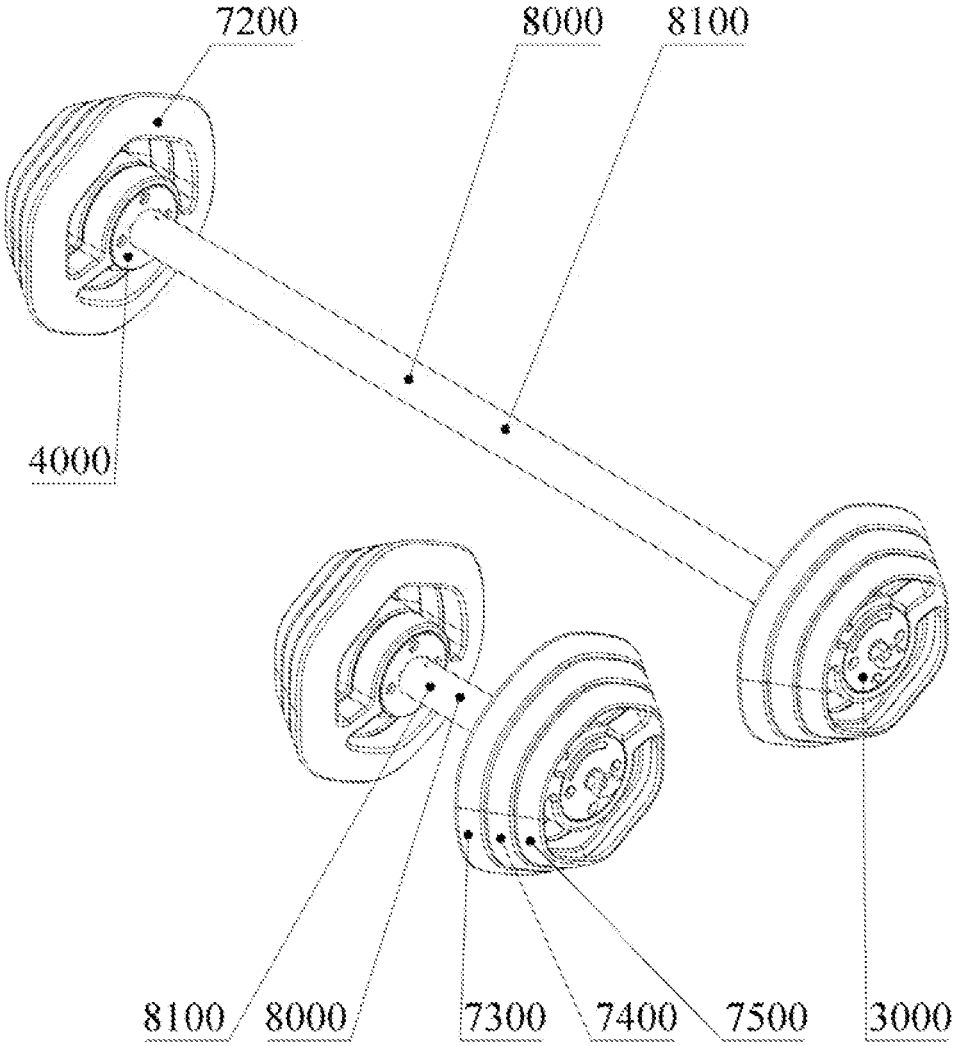
FIG. 11 shows a schematic view of an sharpen with a bell blade.

As shown in FIGS. 9 to 11, in other embodiments of the present invention, a barbell 8000 comprising a sharpen 8100 and a plurality of bell blades 7200, and a connection mechanism as proposed in the present invention, wherein the sharpen 8100 is provided with at least one first pin hole 8101 at each end, the sharpen 8100 is provided with a connection post 8200 at each end, the connection post 8200 is provided with at least one second pin hole 8201, the second pin hole 8201 corresponding to the first pin hole 8101, the connection post 8200 is provided with a fifth through hole 8202, the fifth through hole 8202 corresponding to the limit block 2200, and the sharpen 8100 forms a fixed connection with the connection post 8200, and the limit block 2200. In other embodiments (not shown in the figures), the connection of the connection post and sharpen is not limited to a pin connection, but may also be a screw connection, a weld connection, and any other connection that meets the wishes. In some embodiments (not shown in the figures), the sharpen is provided with a non-slip pattern or may be provided with other non-slip devices.

As shown in FIGS. 9 to 11, when said barbell 8000 is in use, the limit block 2200 enters the limit hole 5001 of the limit plate 5000 insertion hole 4100 of locking mechanism, the restrictor 5002 of limit hole 5001 receives and locks limit block 2200, and when barbell 8000 is in stowage, the limit plate 5000's release section 5003 releases said limit block 2200, the limit block 2200 traveling insertion hole 4100 away from sharpen or another bell blade 7000.

Figure 12:
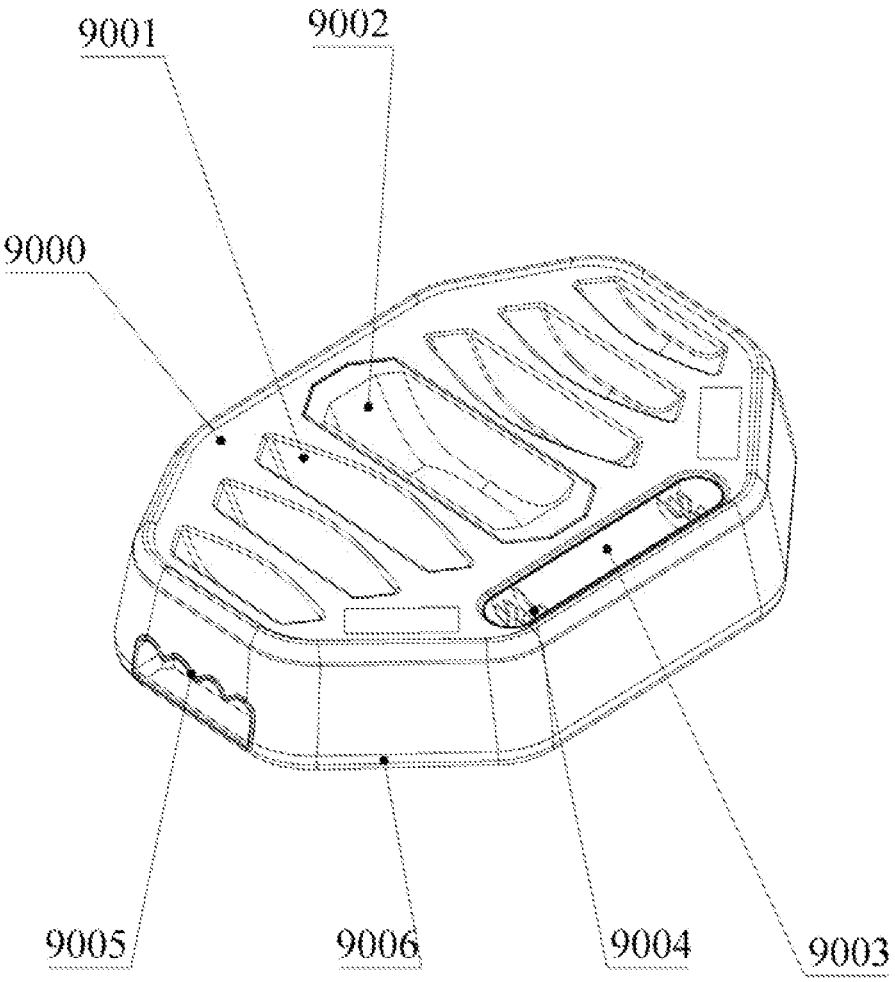
FIG. 12 shows a schematic view of a bottom box.
Figure 13:
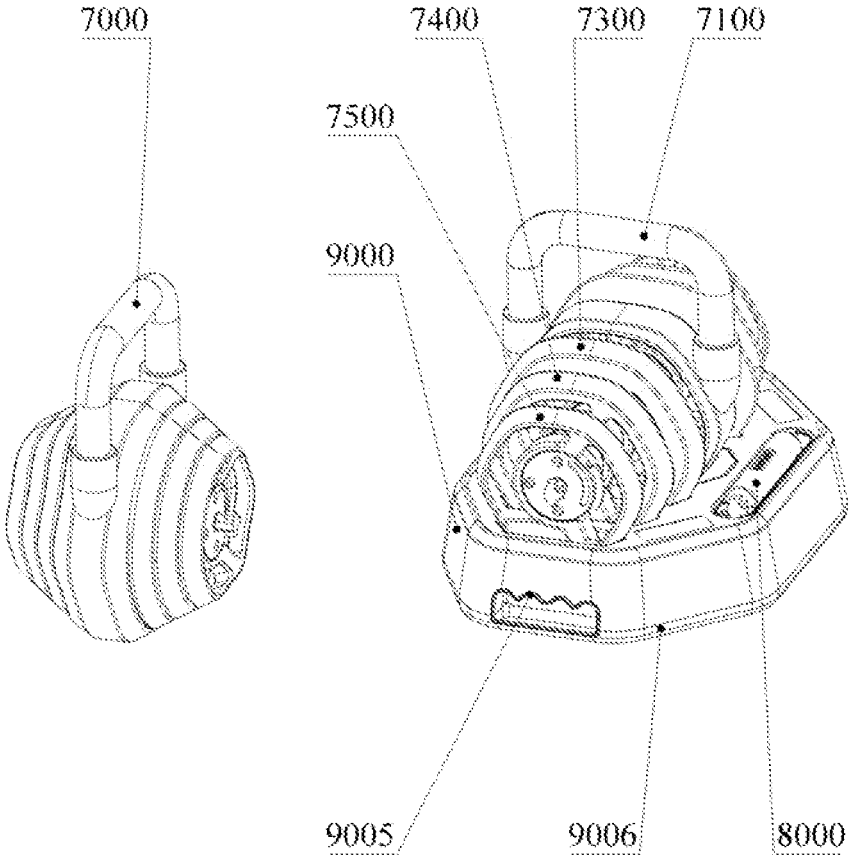
FIG. 13 shows a schematic view of a kettlebell and a bottom box when assembled.

As shown in FIGS. 12 to 13, the present invention is provided with a bottom box 9000 for placement, the bottom box 9000 is provided with a plurality of placement kettlebell slot 9001, the kettlebell slot 9001 with main part in the center being provided with a kettlebell tray 9002, and a kettlebell holder 9003, with the kettlebell holder 9003 being provided with cards 9004 within the kettlebell holder 9003 for catching limit block, which can further fix the barbell 8000. The bottom box 9000 is also provided with grip slots 9005 on both sides, which can be easily held and put down by the base, and kettlebell tray 9006 is also provided at the bottom.

The technical means disclosed in the scheme of the present invention are not limited to the technical means disclosed in the above embodiments, but also include the technical scheme consisting of any combination of the above technical features. It should be noted that, for those skilled in the art, various improvements and embellishments can be made without departing from the principle of the present invention, and these improvements and embellishments are also considered to be within the scope of protection of the present invention.

The invention has now been described in detail for the purposes of clarity and understanding. However, those skilled in the art will appreciate that certain changes and modifications may be practiced within the scope of the appended claims.

What is claimed is:

1. A bell blade connecting mechanism comprising:

a locking mechanism and a connection;

wherein said locking mechanism comprises an upper base, a lower base fixedly connected to said upper base, and a limit plate, said limit plate being elastically connected to said upper base and having a locking position and a release position, said limit plate being provided with a limit hole, said limit hole comprising a restrictor and a release section, said lower base being provided with an insertion hole, said insertion hole defining a passageway for an external object to reach said limit hole, said connection includes a latch and said connection forms a fixed connection with said upper base;

wherein the limit hole is not aligned with the passageway defined by the insertion hole based on when the limit plate is in the locking position, and the limit hole is aligned with the passageway defined by the insertion hole based on when the limit plate is in the release position.

2. The bell blade connecting mechanism according to claim 1, wherein said upper base is provided with at least one hexagonal groove at a first end face, said hexagonal groove is provided with a first through hole within said hexagonal groove, said upper base is provided with an insertion slot at a second end face which can accommodate said limit plate, a first end face of the lower base is provided with at least one second through hole corresponding to said first through hole, a second end face of said lower base is provided with a round slot communicating with said at least one second through hole, and said upper base with said lower base and said limit plate are formed into a fixed connection by screws.

3. The bell blade connection mechanism according to claim 2, wherein said limit plate is provided with a clip block at one end, said clip block being pivotally connected to an elastomer, said limit plate provided with a tab, said upper base provided with said insertion slot, a hexagonal slot provided within the insertion slot limiting up and down movement of the tab, wherein said limit plate reaches an unlocked position based on when said tab comes into contact with one end of said hexagonal slot proximate to said elastomer, and said limit plate reaches a release position based on when said tab comes into contact with the other end of said hexagonal slot.

4. The bell blade connection mechanism according to claim 3, wherein said limit hole comprises said restrictor and said release section, said release section corresponding to said latch, said restrictor limiting said latch's rotational range, wherein when said limit plate is in the locking position, said latch cannot enter said limit hole or said latch is stuck by said restrictor and cannot leave said limit hole, and when said limit plate is in the release position, said latch is free to enter or exit said limit hole and can be rotated to said restrictor or said release section.

5. The bell blade connecting mechanism according to claim 4, wherein the first end face of said upper base is provided with a fixed slot securing said connection, said fixed slot corresponding to said connection, said fixed slot corresponding to said connection and said latch forming a fixed connection with the fixed slot.

6. A kettlebell comprising:

a main part and a plurality of bell blades;

said main part comprising a frame, a center block, a connecting arm connecting said frame and said center block, wherein said center block is provided with a connecting limit block;

said bell blades comprising a connection, a hub having an outer periphery, an outer ring defined by said outer periphery, wherein said hub has an active cavity, said active cavity having a locking mechanism mounted thereon;

said locking mechanism comprising: an upper base; a lower base fixedly connected to said upper base; and a limit plate, wherein said limit plate is elastically connected to said upper base and has a locking position and a release position, and wherein said limit plate is provided with a limit hole, said limit hole comprising a restrictor and a release section, said lower base being provided with an insertion hole, said insertion hole defining a passageway for an external object to reach said limit hole, the connection includes a latch and said connection forms a fixed connection to said upper base;

wherein said limit hole is not aligned with said passageway defined by said insertion hole when said limit plate is in said locking position, and said limit hole is aligned with said passageway defined by said insertion hole when said limit plate is in the release position;

wherein when said kettlebell is in use, said locking mechanism on said bell blades receives and locks said limit block, and wherein when said kettlebell is in a stowed position, said locking mechanism releases said limit block, and said bell blades can be moved away from said main part or other said bell blades.

7. The kettlebell according to claim 6, wherein said center block is provided with an insert corresponding to said upper base, said upper base is provided with an insertion slot corresponding to said limit block on a first end face of said upper base, and said center block, said upper base and said limit block forms a fixed connection by screws.

8. The kettlebell according to claim 7, wherein said hub is provided with an attachment table that can be embedded in said locking mechanism, said first end face of said upper base is provided with at least one hexagonal groove, said hexagonal groove is provided with a first through hole within said hexagonal groove, and a second end face of said upper base is provided with the insertion slot that can accommodate said limit plate, said attachment table being provided with a fourth through hole corresponding to said first through hole, a first end face of said lower base being provided with at least one second through hole corresponding to said first through hole, a second end face of said lower base being provided with a round slot communicating with said at least one second through hole.

9. The kettlebell according to claim 8, wherein said limit plate is provided with a clip block at one end, said clip block is pivotally connected to said elastomer, said insertion slot receives a receiver block of said elastomer, said upper base is provided with the insertion slot with a hexagonal slot limiting up and down movement of the tab, wherein said limit plate reaches an unlocked position based on when said tab contacts one end of said hexagonal slot proximate to said elastomer, and said limit plate reaches a locking position based on when said tab contacts the other end of said hexagonal slot.

10. The kettlebell according to claim 9, wherein said limit hole comprises said restrictor and said release section, said release section corresponding to said latch, said restrictor limiting said latch's rotational range, wherein when said limit plate is in a locked position, said latch is unable to enter said limit hole or said latch is stuck by said restrictor and is unable to leave said limit hole, and when the limit plate is in a released position, said latch is free to enter and exit said limit hole and is rotatable toward the restrictor or said release section.

11. A barbell comprising:

sharpen and a plurality of bell blades;

wherein said sharpen is provided with a limit block at each end;

wherein said bell blades comprise a connection, a hub having an outer periphery, an outer ring defined by said outer periphery, wherein said hub has an active cavity, said active cavity having a locking mechanism mounted therein;

said locking mechanism comprising an upper base, a lower base fixedly connected to said upper base, and a limit plate, said limit plate being elastically connected to said upper base and having a locking position and a release position, said limit plate being provided with a limit hole, said limit hole comprising a restrictor and a release section, said lower base being provided with an insertion hole, said insertion hole defining a passageway for an external object to reach said limit hole, the connection includes a latch and said connection forms a fixed connection to the upper base;

wherein said limit hole is not aligned with a passageway defined by said insertion hole based on when said limit plate is in said locking position, and said limit hole is aligned with said passageway defined by said insertion hole based on when said limit plate is in the release position;

wherein when said barbell is in use, said locking mechanism on said bell blades receives and locks said limit block, and when said barbell is in a stowed position, said locking mechanism releases said limit block, and said bell blades can be moved away from said sharpen or other said bell blades.

12. The barbell according to claim 11, wherein said sharpen is provided with at least one first pin hole at each end of said sharpen, said sharpen being provided with a connection post at each end of said sharpen, said connection post being provided with at least one second pin hole corresponding to said first pin hole, said connection post being provided with a fifth through hole, said fifth through hole corresponding to said limit block.

13. The barbell according to claim 12, wherein said hub is provided with an attachment table that can be embedded in said locking mechanism, said upper base is provided with at least one hexagonal groove at a first end face, said hexagonal groove is provided with a first through hole within said hexagonal groove, and said upper base is provided with a second end face that can accommodate said limit plate, said attachment table is provided with a fourth through hole corresponding to said first through hole, said lower base is provided with at least one second through hole corresponding to said first through hole on its first end face, and said lower base is provided with a round slot on its second end face which is in communication with said at least one second through hole.

14. The barbell according to claim 13, wherein one end of said limit plate is provided with a clip block, said clip block being pivotally connected to an elastomer, said limit plate being provided with a tab, said upper base being provided with said insertion slot with a hexagonal slot limiting up and down movement of the tab, wherein said limit plate reaches a release position when said tab comes into contact with an end of said hexagonal slot proximate to said elastomer, and said limit plate reaches a locked position based on when said tab comes into contact with the other end of said hexagonal slot.

15. The barbell according to claim 14, wherein said limit hole comprises a restrictor and a release section, said release section corresponding to said latch, said restrictor restricting the rotational range of said latch, wherein when said limit plate is in a locked position, said latch is unable to exit the limit hole or said latch is stuck by said restrictor and is unable to leave said limit hole, and wherein when said limit plate is in a release position, said latch is free to enter and exit said limit hole and may be rotated to said restrictor or said release section.

* * * * *